US012053026B2

(12) United States Patent
Ouyang

(10) Patent No.: US 12,053,026 B2
(45) Date of Patent: Aug. 6, 2024

(54) ATOMIZER AND AEROSOL GENERATOR HAVING THE SAME

(71) Applicant: HONG KONG IVPS INTERNATIONAL LIMITED, Central (HK)

(72) Inventor: Junwei Ouyang, Shenzhen (CN)

(73) Assignee: HONG KONG IVPS INTERNATIONAL LIMITED, Central (HK)

( * ) Notice: Subject to any disclaimer, the term of this patent is extended or adjusted under 35 U.S.C. 154(b) by 287 days.

(21) Appl. No.: 17/524,812

(22) Filed: Nov. 12, 2021

(65) Prior Publication Data

US 2022/0202100 A1 Jun. 30, 2022

(30) Foreign Application Priority Data

Dec. 31, 2020 (CN) ..... 202011634464.X

(51) Int. Cl.
*A24F 40/10* (2020.01)
*A24F 40/42* (2020.01)
*A24F 40/49* (2020.01)

(52) U.S. Cl.
CPC ..... *A24F 40/49* (2020.01); *A24F 40/10* (2020.01); *A24F 40/42* (2020.01)

(58) Field of Classification Search
CPC ..... A24F 40/10; A24F 40/40; A24F 40/42; A24F 40/49
See application file for complete search history.

(56) References Cited

U.S. PATENT DOCUMENTS

| | | | | |
|---|---|---|---|---|
| 9,799,989 | B1 * | 10/2017 | Zhu | H01R 24/005 |
| 11,547,152 | B2 * | 1/2023 | Schennum | A24F 40/95 |
| 11,589,618 | B2 * | 2/2023 | Ouyang | H05B 3/46 |
| 11,744,284 | B2 * | 9/2023 | Liu | A24F 40/46 131/329 |
| 2020/0138117 | A1 * | 5/2020 | Rosser | A61M 11/042 |
| 2020/0253279 | A1 * | 8/2020 | Liu | A24F 40/05 |
| 2022/0354179 | A1 * | 11/2022 | Kokadir | A24F 40/10 |
| 2024/0100271 | A1 * | 3/2024 | Simpson | A61M 15/06 |

FOREIGN PATENT DOCUMENTS

| | | | | |
|---|---|---|---|---|
| WO | WO-2018188642 | A1 * | 10/2018 | A24B 15/167 |
| WO | WO-2019063008 | A1 * | 4/2019 | A24F 40/05 |
| WO | WO-2019063016 | A1 * | 4/2019 | A24F 40/05 |
| WO | WO-2023067357 | A1 * | 4/2023 | |

* cited by examiner

*Primary Examiner* — Abdullah A Riyami
*Assistant Examiner* — Thang H Nguyen
(74) *Attorney, Agent, or Firm* — Thompson Hine LLP

(57) ABSTRACT

The present disclosure discloses an electronic atomization device and an aerosol generator. The electronic atomization device includes a shell, an atomization core assembly, and a locking piece. The atomization core assembly is detachably mounted in the mounting hole. The first end of the locking piece is rotationally connected with an open end of the mounting hole, and the second end of the locking piece is detachably connected with the shell. When the first end rotates to the second end and connects to the shell, the locking piece partially protrudes in the mounting direction of the atomization core assembly and blocks the atomization core assembly from moving in the mounting direction. When the second end is disconnected from the shell and rotates around the first end in the direction away from the shell, the locking piece unlocks the atomization core assembly.

20 Claims, 7 Drawing Sheets

ATOMIZER AND AEROSOL GENERATOR HAVING THE SAME

CROSS-REFERENCE TO RELATED APPLICATION

This application claims priority to Chinese Patent Application No. 202011634464.X filed on Dec. 31, 2020, which is incorporated herein by reference in its entirety.

TECHNICAL FIELD

This disclosure relates to an electronic atomization device and an aerosol generator using thereof.

BACKGROUND

At present, aerosol generator usually consists of an atomization device and an power supply device. An atomization device for atomizing juice and generating aerosol is provided in the atomization device. The existing atomization core assembly mainly adopts two assembling methods, including non-detachably fixed in the atomization device and detachably assembled in the atomization device. Since the heating element and juice-guiding element in the atomization core assembly keep being aged during use, the detachable atomization core assembly should be removed from the atomization device after aged and replaced with a new atomization core assembly. By this way, the main body of the atomization device can be reused to reduce the user's cost and is more friendly to the environment. Therefore, the detachable atomization core assembly has been widely used. However, the existing detachable atomization core assembly is mainly assembled in the manner of interference fit or threaded connection with the main body. In the case of no child lock, the atomization core assembly tends to be taken out by children or users by mistake due to such simple structures of these two connections, which will lead to juice leaking and have potential safety hazards.

Therefore, the existing technique needs to be modified and improved.

SUMMARY

The main purpose of present disclosure is to provide an electronic atomization device and an aerosol generator, which is aimed to solve the problem that the atomization core assembly can be easily taken out by mistake.

The technical solution adopted by the present disclosure achieves the above purpose as follows:

An electronic atomization device comprising a shell provided with a mounting hole, an atomization core assembly, and a locking piece. The atomization core assembly is detachably mounted in the mounting hole. One end of the atomization core assembly is accommodated in the shell to form an oil storage cavity, and the other end of the atomization core assembly is accommodated outside the shell. The first end of the locking piece is rotationally connected with an open end of the mounting hole, and the second end of the locking piece is detachably connected with the shell. When the first end rotates to the second end and connects to the shell, the locking piece partially protrudes in the mounting direction of the atomization core assembly and blocks the atomization core assembly from moving in the mounting direction. When the second end is disconnected from the shell and rotates around the first end in the direction away from the shell, the locking piece unlocks the atomization core assembly.

The electronic atomization, wherein the locking piece comprises a body and a shielding part connected to the body. One end of the body is provided with a rotating column in penetrating manner. The rotating column is rotatably connected with an open end, and the opposite end is provided with a clamping part. When the body is forced to rotate around the rotating column, the clamping part and the shielding part are driven to rotate until the clamping part is clamped on the shell, and the shielding part protrudes in the mounting direction of the atomization core assembly.

The electronic atomization, wherein the shielding part comprises a connecting plate connected to the body and a baffle plate connected to the connecting plate. The connecting plate extends along the axial direction of the mounting hole, and the baffle plate extends along the radial direction of the mounting hole and partially protrudes in the mounting hole.

The electronic atomization, wherein the connecting plate is in an arc plate structure arranged parallel to the outer wall of the mounting hole. When the body rotates until the clamping part is clamped on the shell, the connecting plate attaches to the outer wall of the mounting hole.

The electronic atomization, wherein the body is in an arc structure surrounding the mounting hole, and the open end is provided with an adaptive arc avoidance groove. When the clamping part is clamped on the shell, the body is completely accommodated in the arc avoidance groove.

The electronic atomization, wherein the clamping part is a buckle slot arranged on the body. The shell is provided with a buckle adapted to the buckle slot, and the buckle slot is detachably engaged with the buckle.

The electronic atomization, wherein the rotating column comprises a column body and a column cap. The body is provided with a first connecting hole, and the shell is provided with a second connecting hole. One end of the column body passes through the first connecting hole with clearance and is interference inserted into the second connecting hole, and the other end is connected to the column cap. The column cap is attached to the end face of the first connecting hole.

The electronic atomization, wherein the part of the column body accommodated in the second connecting hole is provided with at least one circular barb along the circumferential direction. The circular barb is embedded in the hole wall of the second connecting hole, and the outer diameter of the circular barb gradually expands along the direction close to the first connecting hole.

The electronic atomization, wherein the side of the atomization core assembly accommodated outside the shell is provided with a groove along the circumferential direction. When the locking piece rotates to the second end and connects to the shell, the part of the locking pieces protruding along the mounting direction extends into the groove and is located between the opposite inner walls of the groove.

The electronic atomization, wherein one side of the locking piece is attached to the open end, and the other side is exposed. A handle slot is provided for the user to apply force.

The electronic atomization, wherein the aerosol generator comprises a power supply unit and an electronic atomization device according to any of claims 1-10, and said power supply unit is electrically connected to the electronic atomization device.

The present disclosure provides an electronic atomization device and an aerosol generator. The electronic atomization device comprises a shell provided with a mounting hole, an atomization core assembly, and a locking piece. The atomization core assembly is detachably mounted in the mounting hole. One end of the atomization core assembly is accommodated in the shell to form a juice storage cavity, and the other end of the atomization core assembly is accommodated outside the shell. The first end of the locking piece is rotationally connected with an open end of the mounting hole, and the second end of the locking piece is detachably connected with the shell. When the first end rotates to the second end and connects to the shell, the locking piece partially protrudes in the mounting direction of the atomization core assembly and blocks the atomization core assembly from moving in the mounting direction. When the second end is disconnected from the shell and rotates around the first end in the direction away from the shell, the locking piece unlocks the atomization core assembly. Displacement of the atomization core assembly in the installation direction is limited through the locking piece, so that the atomization core assembly is locked, and the use safety of the device is improved.

DESCRIPTION OF THE DRAWINGS

For a more complete understanding of the present disclosure or the technical schemes in the prior art, the drawings in the embodiments or the descriptions of the prior art are briefly introduced. Obviously, the drawings in the following descriptions are only some embodiments of the present disclosure. It will be apparent to those skilled in the art that other drawings may be easily obtained from these drawings without paying any creative effort.

DEFINITION OF EACH REFERENCE NUMBER

Figure 1:
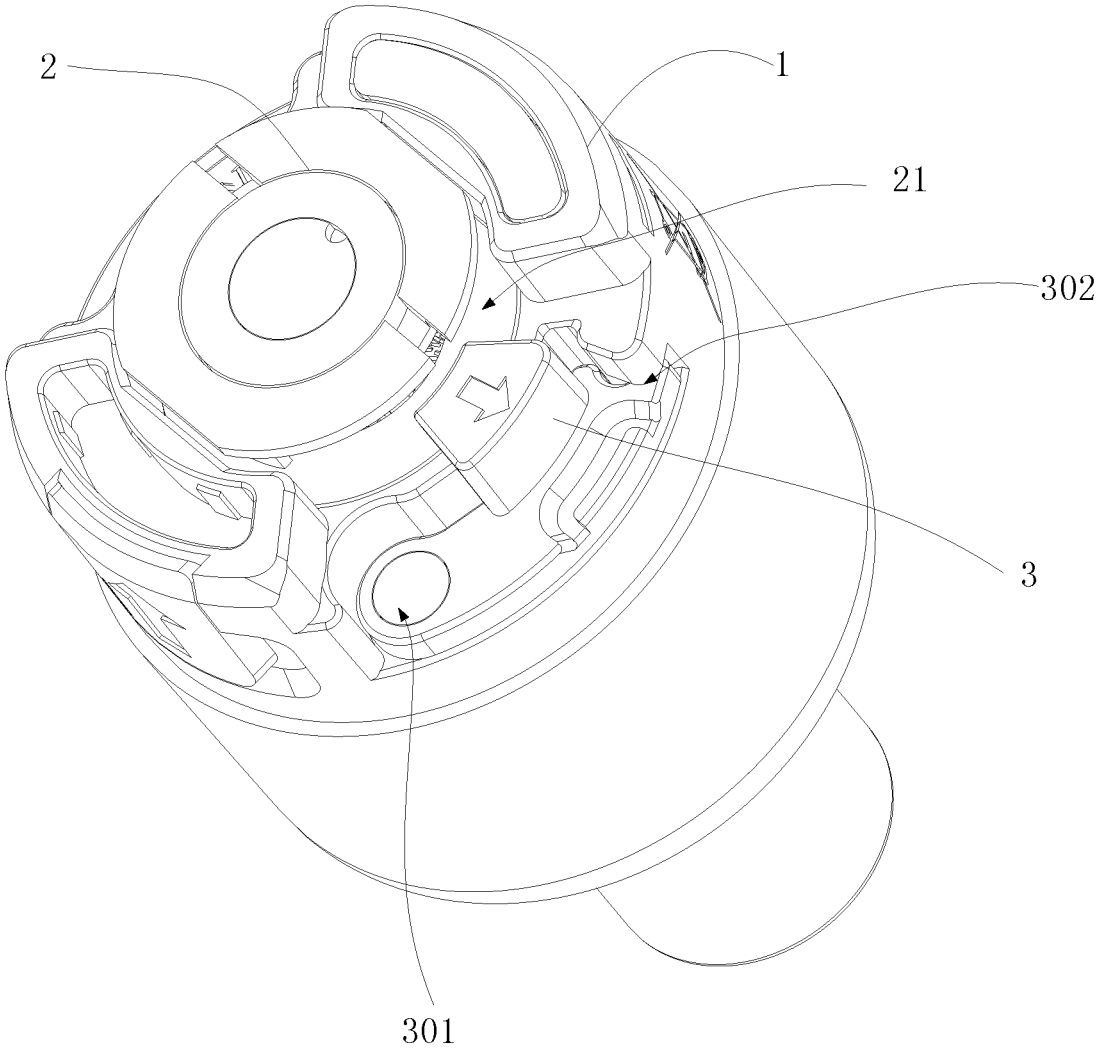
FIG. 1 is a perspective view for preferred embodiment of the electronic atomization device disclosed in the present disclosure.

| Reference number | Name | Reference number | Name |
|---|---|---|---|
| 1 | case | 2 | Atomization core assembly |
| 3 | Locking piece | 4 | Juice storage cavity |

-continued

| Reference number | Name | Reference number | Name |
|---|---|---|---|
| 11 | Accommodation space | 12 | Mounting hole |
| 13 | Arc avoidance groove | 14 | Second connecting hole |
| 15 | Buckle | 21 | Groove |
| 31 | Body | 32 | Rotating column |
| 33 | First connecting hole | 34 | Clamping part |
| 35 | Shielding part | 36 | Handle slot |
| 321 | Column body | 322 | Column cap |
| 3211 | Circular barb | 341 | Buckle slot |
| 351 | Connecting plate | 352 | Baffle plate |
| 301 | First end | 302 | Second end |

The objection's realization, functional characteristics, and advantages of the present disclosure will be further described in conjunction with the embodiments and with reference to the drawings.

DETAILED DESCRIPTION

Technical solutions of embodiments of the present disclosure are described clearly and completely in conjunction with the drawings in the embodiments of the present disclosure hereinafter. Apparently, the described embodiments are only a few rather than all of the embodiments of the present disclosure. Other embodiments obtained by those skilled in the art based on the embodiments of the present disclosure without any creative work fall within the scope of protection of the present disclosure.

It should be noted that all directional indicators (such as up, down, left, right, front, back, etc.) in the embodiments of the present disclosure are only used to explain the relative position between the components in a specific posture (as shown in the drawings) and movement conditions, etc. If the specific posture changes, the directional indication also changes accordingly.

In the description of present application, the "first" or "second" is merely used for description and cannot be understood to indicate or imply relative importance or implicitly indicate the number of the indicated technical features. Therefore, features with a limitation of "first" or "second" can explicitly or implicitly include one or more features. Furthermore, technical schemes of various embodiments can be combined with each other if only it can be implemented by those of ordinary skill in the art. If a combination of the technical schemes is conflict or impracticable, such combination should be considered as not exist and not fall in the scope of protection of the present disclosure.

In the present disclosure, unless otherwise clearly stated and limited, terms of "connect" and "fix" should be understood broadly. For instance, "fix" can be a fixed connection, a detachable connection, or an integral connection. Further, "fix" can be a mechanical connection, can also be an electrical connection, can also be a direct connection, can also be an indirect connection by an intermediary, and can also be an internal communication of two elements, unless otherwise clearly limited. A person skilled in the art can understand concrete meanings of the terms in the present disclosure as per specific circumstances.

Reference to FIG. 1 to FIG. 7, the present disclosure provides schematic view for preferred embodiment of the electronic atomization device disclosed in the present disclosure. The electronic atomization device comprises a shell 1, an atomization core assembly 2, and a locking piece 3. The shell 1 is provided with an accommodation space 11 and a mounting hole 12 communicated with the accommodation space 11. The atomization core assembly 2 is detachably mounted in the mounting hole 12. One end of the atomization core assembly 2 extends into the accommodation space 11 through the mounting hole 12 and forms an airtight juice storage chamber 4 with the shell 1, and the other end extends out of the shell 1 through the mounting hole 12. The first end 301 of said locking piece 3 is rotationally connected with an open end of the mounting hole 12, and the second end 302 of the locking piece is detachably connected with the shell 1. When the first end 301 rotates to the second end 302 and connects to the shell 1, the locking piece 3 partially protrudes in the mounting direction of the atomization core assembly 2 and blocks the atomization core assembly 2 from moving in the mounting direction, which limit disassembly of the atomization core assembly 2 and solve the problem that the atomization core assembly 2 can be easily taken out by mistake. When the second end 302 is disconnected from the shell 1 and rotates around the first end 301 in the direction away from the shell 1, the locking piece 3 deviates from the installation direction and unlocks the atomization core assembly 2, then the atomization core assembly 2 can be removed smoothly from the mounting hole 12. In this embodiment, displacement of the atomization core assembly in the installation direction is limited through the locking piece, so that the atomization core assembly 2 is locked, and the use safety of the device is improved.

Figure 4:
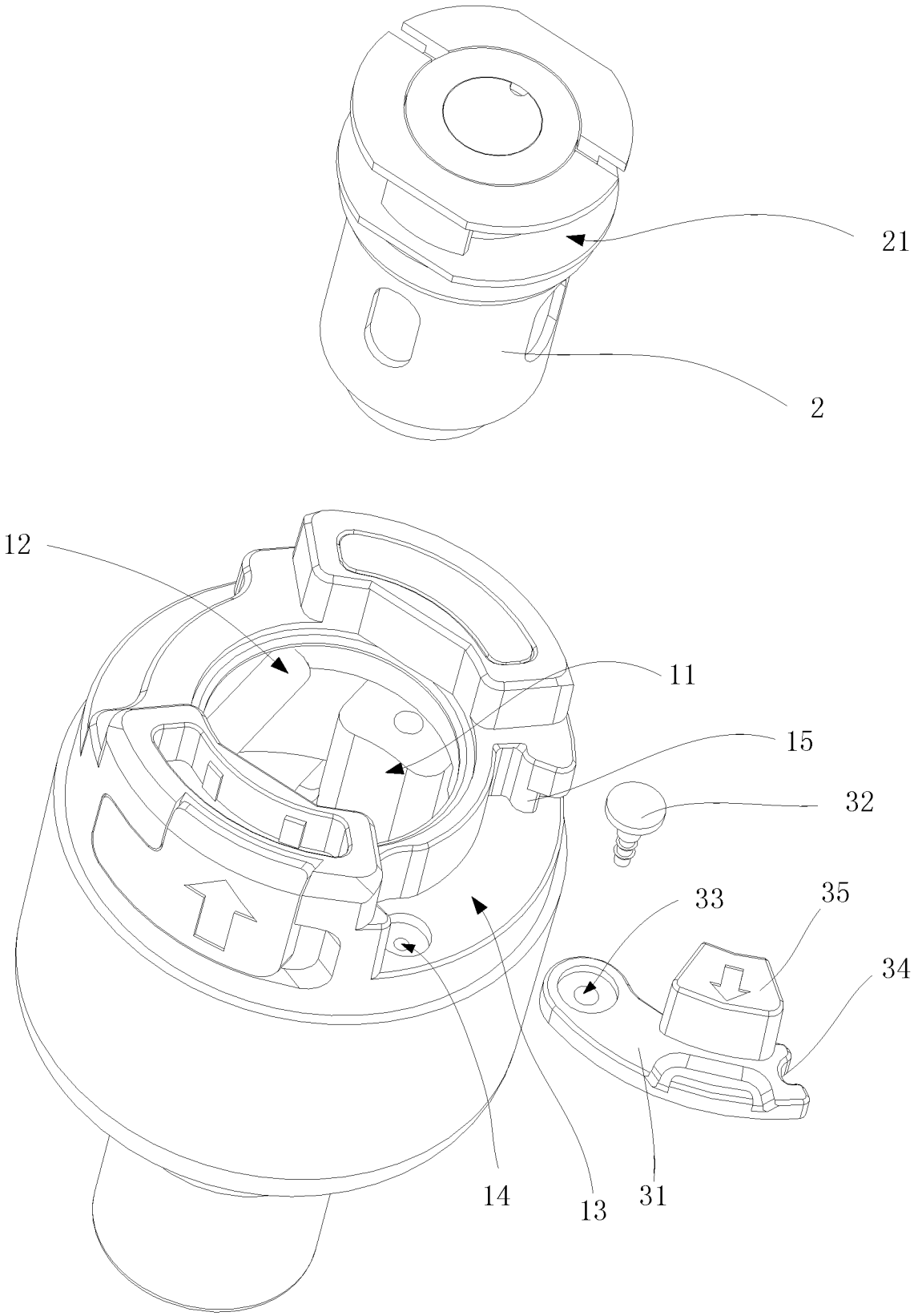
FIG. 4 is an exploded view for preferred embodiment of the electronic atomization device disclosed in the present disclosure.
Figure 5:
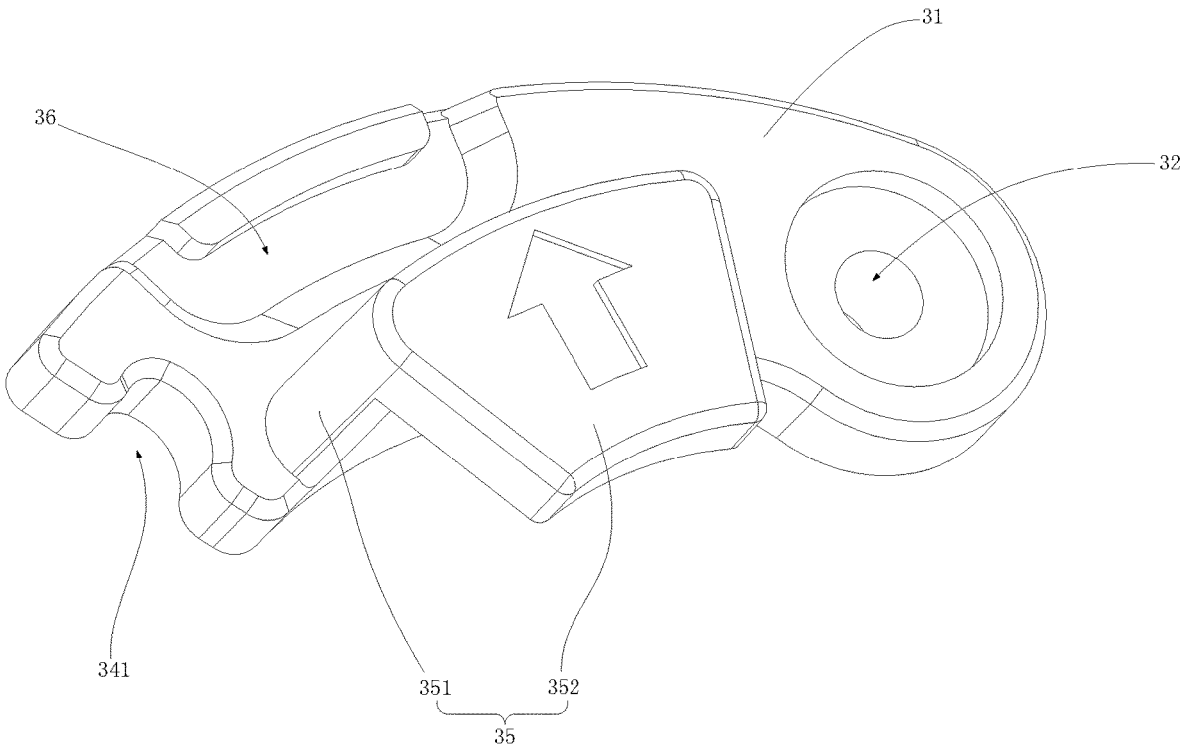
FIG. 5 is a structural diagram of the body for preferred embodiment of the electronic atomization device disclosed in the present disclosure.

In this embodiment, as shown in FIG. 4 and FIG. 5, the locking piece 3 comprise a body 31 and a shielding part 35. One end of the body 31 is provided with a rotating column 32 in penetrating manner, and the opposite end is provided with a clamping part 34. The rotating column 32 is used for rotationally connecting with an open end, and the rotating column 32 comprises a column body 321 and a column cap 322. Correspondingly, the body 31 is provided with a first connecting hole 33, and the open end of the shell 1 is provided with a second connecting hole 14. One end of the column body 321 passes through the first connecting hole 33 to insert into the second connecting hole 14 which is clearance fit with the first connecting hole 33 and interference fit with the second connecting hole 14, so that the column body 321 is fixedly connected with the open end and rotationally connected with the body 31. Thus, when the body 31 is subjected to an external force, the body 31 can rotate relatively to the shell 1 around the rotating column 32. It is worth noting that the rotating column 32 can also be fixedly connected with the body 31 and rotatably connected with the open end. When the body 31 is subjected to an external force, the body 31 drive rotating column 32 to rotate relative to the shell 1.

Figure 6:
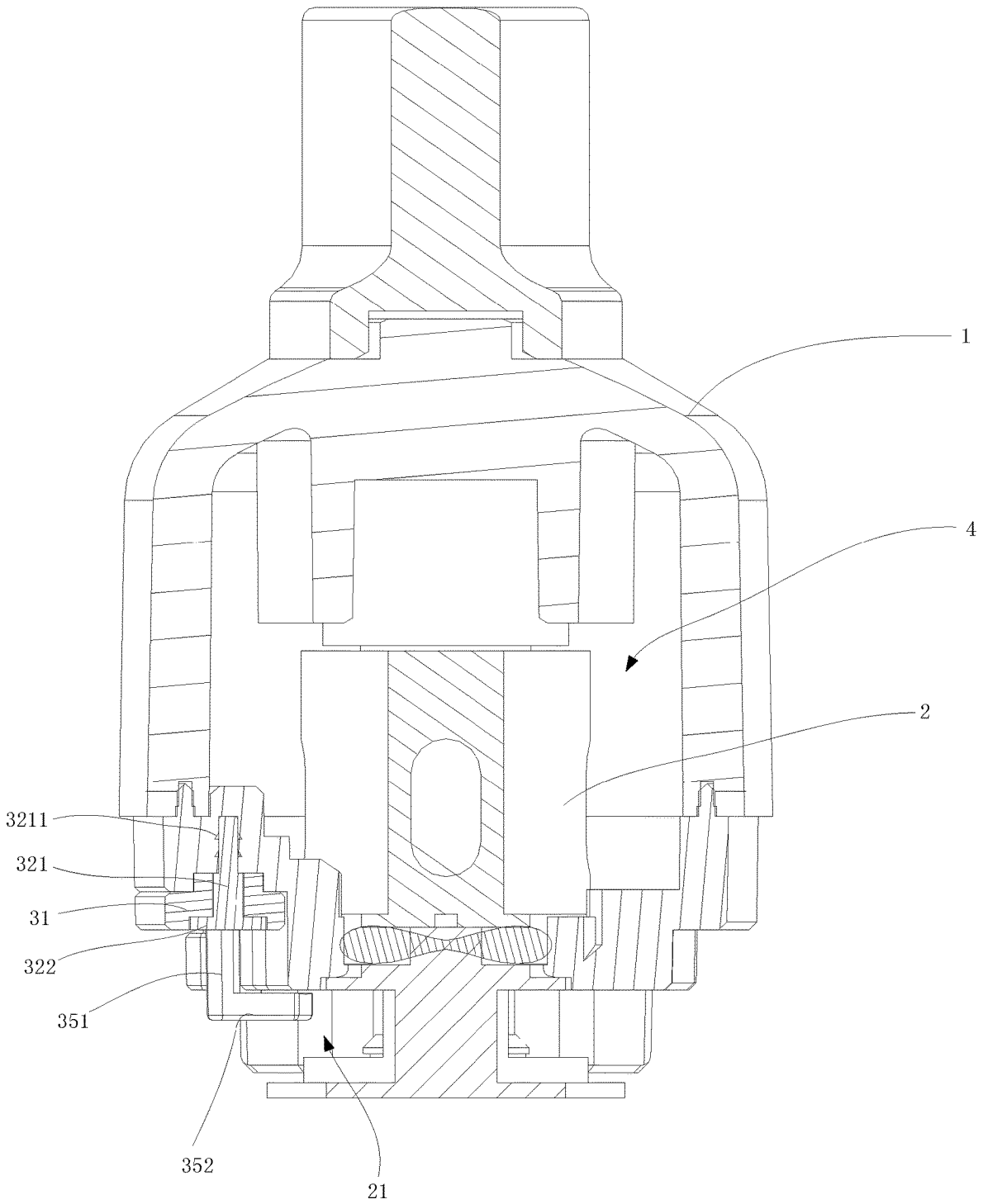
FIG. 6 is a first angle sectional view for preferred embodiment of the electronic atomization device disclosed in the present disclosure.
Figure 7:
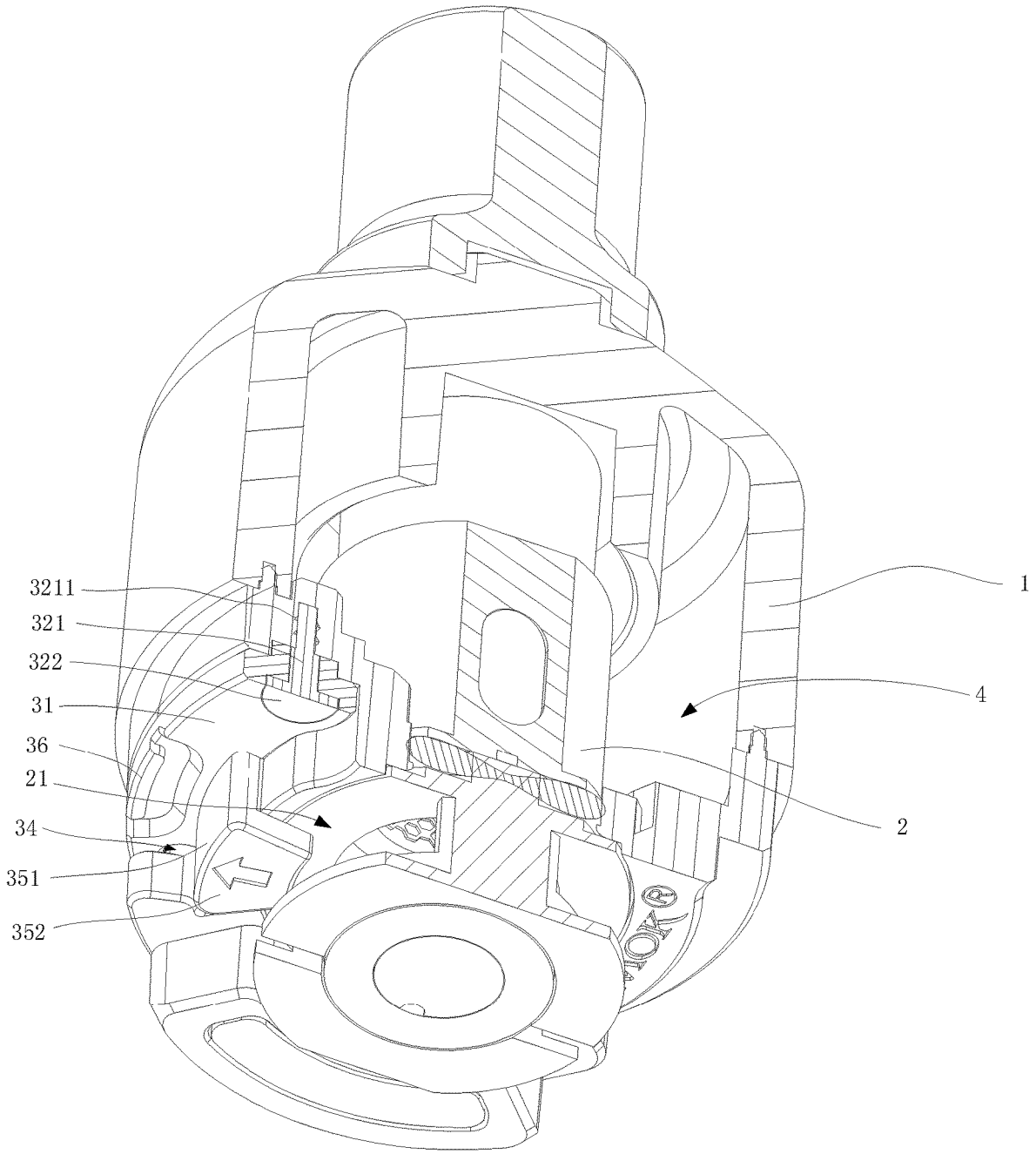
FIG. 7 is a second angle sectional view for preferred embodiment of the electronic atomization device disclosed in the present disclosure.

Preferably, as shown in FIG. 6 and FIG. 7, the part of the column body 321 accommodated in the second connecting hole 14 is provided with at least one circular barb 3211 along the circumferential direction. The circular barb 3211 is embedded in the hole wall of the second connecting hole 14 to increase the connection strength between the main body and the second connection hole 14, as well as prevent the column body 321 from rotating relative to the shell 1. Preferably, the circular barb 3211 is conical, and outer diameter of the circular barb 3211 gradually increases along the direction close to the first connecting hole 33. By this way, when mounting the column body 321, the small end of the circular barb 3211 extends into the second connecting hole 14, which can play a guiding role and facilitate installation. In practical application, at least one circular barb 3211 is a plurality of circular barbs, and the plurality of circular barbs 3211 are arranged at intervals along the axial direction of the column body 321. The acting force between the column body 321 and the second connecting hole 14 can be increased through the plurality of annular barbs 3211, and the force on the column body 321 can be more uniform.

In this embodiment, the other end of the column body 321 extends from one end of the first connecting hole 33 away from the second connecting hole 14 and connected with the column cap 322. The outer diameter of the column cap 322 is larger than the aperture of the first connecting hole 33, so the column cap 322 butts against the end face of the first connecting hole 33 away from the second connecting hole 14 to limit the displacement of the column body 321 along the axial direction.

Furthermore, in order to facilitate the installation of the body 31, the body 31 is provided with a positioning block or positioning groove towards the shell 1. Correspondingly, the shell 1 is provided with a matching positioning groove or positioning block. The body 3 is positioned and pre-installed through the coordination between the positioning block and the positioning groove, which improves the installation efficiency of the column body 321. Preferably, the shell 1 is provided with a positioning groove, and the positioning groove communicates with the first connecting hole 33 to form a counterbore. The rotating column 32 passes through the positioning groove and the first connecting hole 33 successively, and then inserts into the second connecting hole 14 to facilitate installation and increase the connection strength.

Preferably, as shown in FIG. 1 to FIG. 5, the body 31 is in an arc structure extending around the mounting hole 12. Correspondingly, the open end is provided with a matching arc-shaped avoidance groove 13. When the clamping part 34 is engaged with the shell 1, and the body 31 is completely accommodated in the arc-shaped avoidance groove 13 to prevent the locking piece 3 from protruding from the shell 1 and affecting the regularity of the overall structure of the equipment. Furthermore, the end of the body 31 provided with the first connecting hole 33 is in an arc structure, and the arc structure is arranged concentrically with the first connecting hole 33. The corresponding part on the arc-shaped avoidance groove 13 also shows a matching arc structure. By this way, when the body 31 rotates around the column body 321, the part of the body 31 with arc structure adaptively rotates along the part of the arc-shaped avoidance groove 13 in arc structure, which plays a guiding role and makes the rotation more stable and smoother.

In this embodiment, as shown in FIG. 5, the shielding part 35 comprises a connecting plate 351 and a baffle plate 352. The connecting plate 351 is connected to the body 31 and extends along the axial direction of the mounting hole 12. The baffle plate 352 is connected to the connecting plate 351 on the end away from the body 31, extends along the axial direction of the mounting hole 12, and partly protrudes in the mounting hole 12. Since the atomization core assembly 2 is inserted into the shell 1 along the axial direction of the mounting hole 12 from the open end of the mounting hole 12, the part of the baffle plate 352 protruding in the mounting hole 12 is located in the mounting direction of the atomization core assembly 2, which blocks the assembly and disassembly of the atomization core assembly 2.

The connecting plate 351 and the baffle plate 352 can both be a flat plate structure, an arc plate structure, or a column structure. Preferably, the connecting plate 351 is an arc plate structure arranged parallel to the outer wall of the mounting hole 12. When the body 31 rotates until the clamping part 34 is clamped on the shell 1, the connecting plate 351 attaches to the outer wall of the mounting hole 12, which can increase the contact area between the connecting plate 351 and the shell 1 and reduce the probability of damage to the connecting plate 351. In practical application, the baffle plate 352 is in a flat plate structure, and the baffle plate 352 may attaches to the end face of the open end or not. Preferably, the baffle plate 352 is fan-shaped, and outer diameter of the fan shape is equal to the outer diameter of the open end.

Preferably, as shown in FIG. 1 to FIG. 7, the side of the atomization core assembly 2 accommodated outside the shell 1 is provided with a groove 21 along the circumferential direction. The part of the baffle plate 352 protruding into the mounting hole 12 is in the groove 21, that is, between opposite inner side walls of the groove 21. The baffle plate 352 may attach to the side wall of the groove 21, or there may be a gap between the baffle plate 352 and the side wall. Preferably, the baffle plate 352 is attached to the inner wall of the groove 21 close to the shell 1, so that when a pull force is applied on the atomization core assembly 2, the inner side wall of the groove 21 abuts against the baffle plate 352 to prevent the atomization core assembly 2 from displacement along the axial direction of the mounting hole 12 and effectively prevent the atomization core assembly 2 from being taken out by the user or children, which plays a role in locking the atomization core assembly 2. In practical application, the baffle plate 352 can also attach to the end face of the atomization core assembly 2 outside the shell 1. Correspondingly, the connecting plate 351 extends slightly beyond the atomization core assembly 2 along the axial direction of the mounting hole 12, that is, the length of the connecting plate 351 is slightly longer than the length of the atomization core assembly 2 extending out of the shell 1, which can also effectively prevent the removal of the atomization core assembly 2 by mistake.

Figure 2:
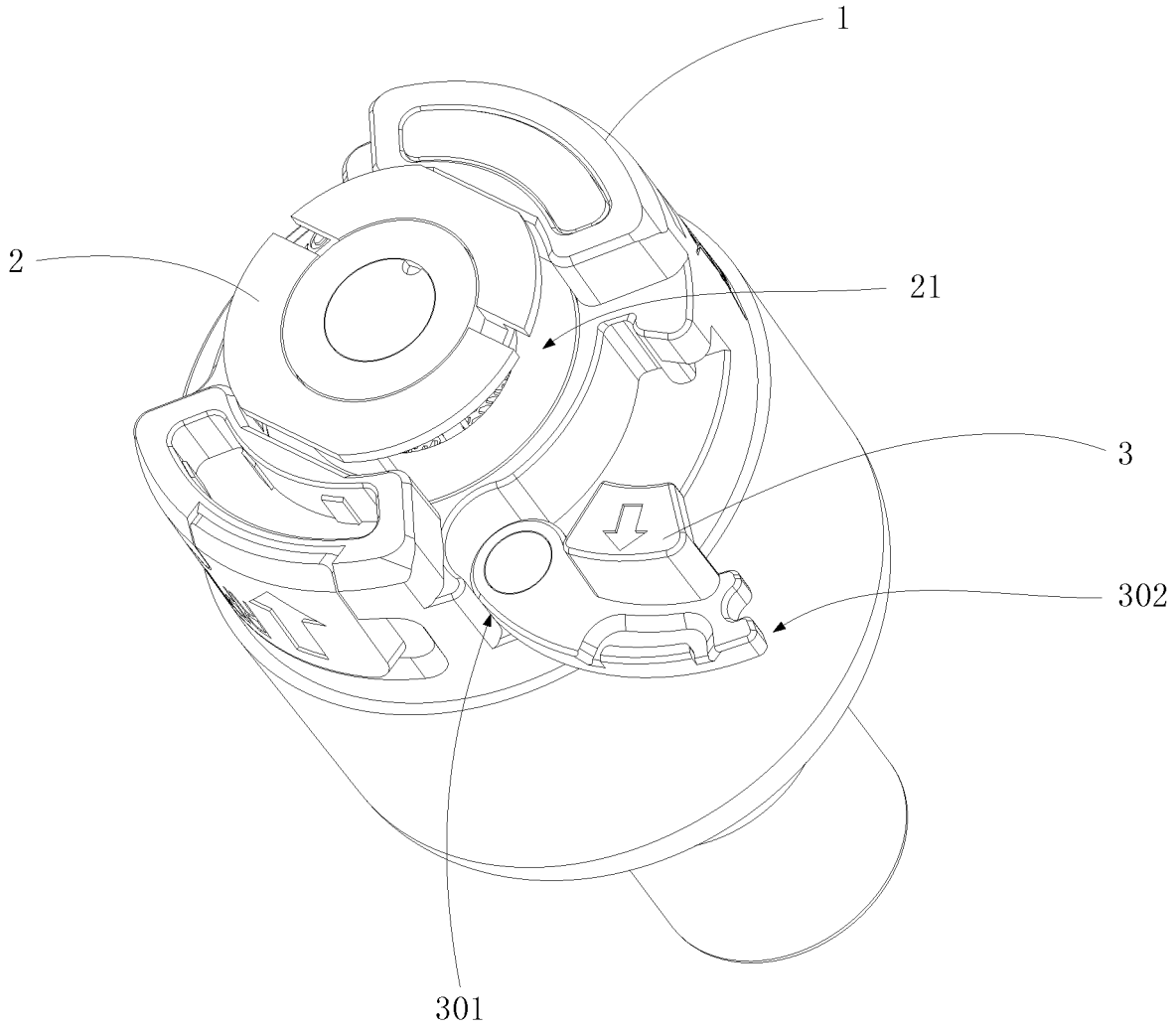
FIG. 2 is a diagram of locking piece under unlocked status for preferred embodiment of the electronic atomization device disclosed in the present disclosure.
Figure 3:
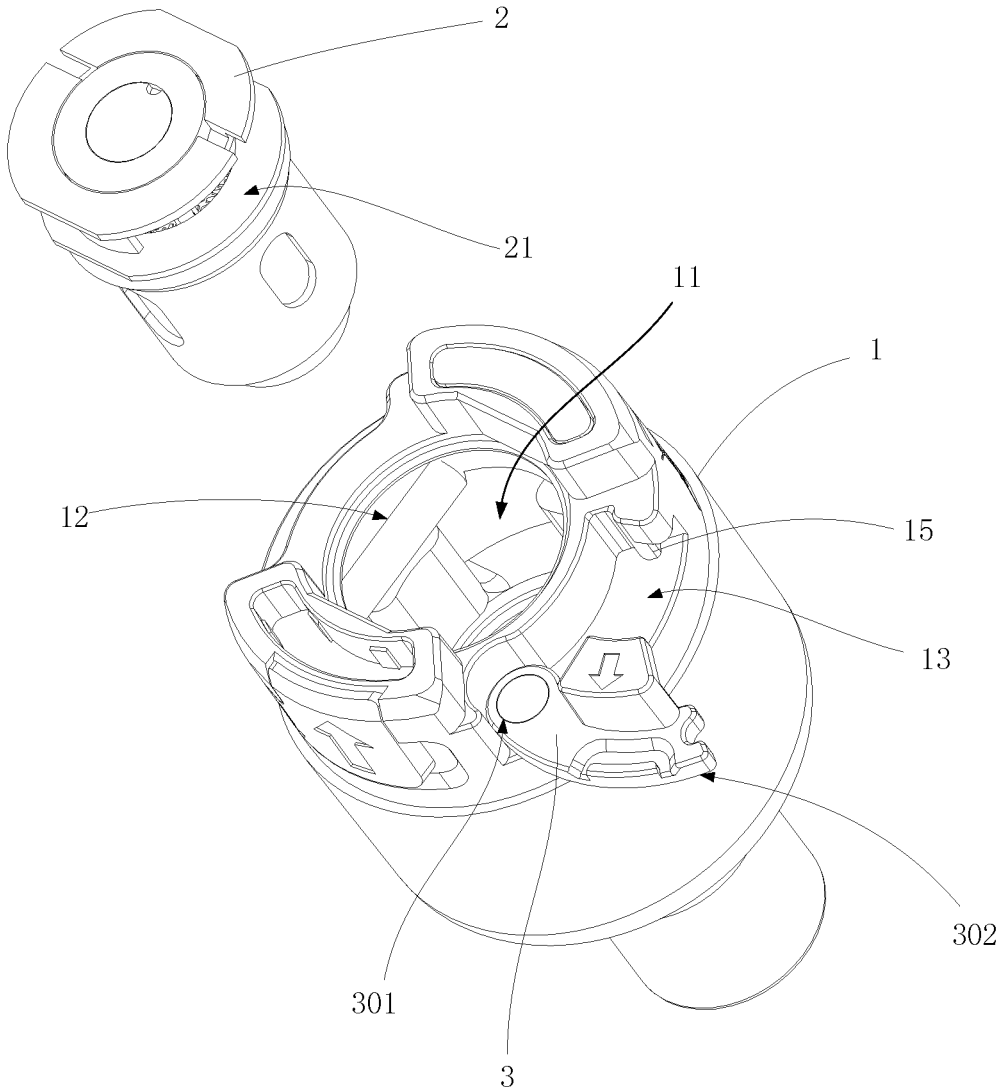
FIG. 3 is a diagram of the status that the atomization core assembly has been removed for preferred embodiment of the electronic atomization device disclosed in the present disclosure.

In this embodiment, as shown in FIG. 5, the clamping part 34 is a buckle slot 341 arranged on the body 31. The shell 1 is provided with a buckle 15 adapted to the buckle slot 341, and the buckle slot 341 is detachably engaged with the buckle 15. In practical application, the clamping part 34 can also be a buckle 15, and the shell 1 is provided with a matching buckle slot 341 to form a detachable clamping structure. After the atomization core assembly 2 is mounted by the detachable clamping structure, it is only necessary to press the clamping part 34 towards the shell 1 to clamp. As shown in FIG. 2 and FIG. 3, for taking out the atomization core assembly 2, just pull the clamping part 34 out of the shell 1 to release the connection with the buckle 15, which is easy to operate. Preferably, one side of the body 31 is attached to the open end, and the other side is exposed. A handle slot 36 is provided for the user to apply force. The user applies force on the handle slot 36 to separate the buckle slot 341 from the buckle 15, and the body 31 rotates around the rotating column 32 to unlock the atomization core assembly 2.

The present disclosure also discloses an aerosol generator. The aerosol generator comprises an electronic atomization device. The specific structure of the electronic atomization device refers to above mentioned embodiment. The aerosol generator adopts all the technical schemes of all above embodiments, therefore at least it shows all the beneficial effects brought by the technical schemes of the above embodiments, which will not be repeated here.

The above only describes preferred embodiments of the present disclosure and is not intended to limit the patent scope of the present disclosure. Any equivalent structural transformation made by using contents of the description and drawings of the present disclosure, or directly or indirectly used in other relevant technical fields under the inventive concept of the present disclosure shall be included within the protection scope of patent of the present disclosure.

The invention claimed is:

1. An electronic atomization device comprising:

a shell comprising a mounting hole;

an atomization core assembly comprising a first end and a second end, wherein the atomization core assembly is detachably mounted in the mounting hole, wherein the first end of the atomization core assembly is accommodated in the shell to form a juice storage cavity, and the second end of the atomization core assembly is accommodated outside of the shell; and a locking piece comprising a first end and a second end, wherein:

the first end of the locking piece is rotationally connected with an open end of the mounting hole, the second end of the locking piece is detachably connected with the shell, the first end of the locking piece is configured to rotate to the second end of the locking piece and to connect to the shell, a portion of the locking piece partially protrudes in a mounting direction of the atomization core assembly, and is configured to block the atomization core assembly from moving in the mounting direction, when the second end of the locking piece is disconnected from the shell, and the locking piece is configured to rotate around the first end in the direction away from the shell, and the locking piece is configured to unlock the atomization core assembly, wherein a first side of the atomization core assembly accommodated outside the shell comprises a groove along a circumferential direction, and wherein, when the locking piece rotates to the second end of the atomization core assembly and connects to the shell, the portion of the locking piece that partially protrudes along the mounting direction extends into the groove and is located between the opposite inner walls of the groove.

2. The electronic atomization device of claim 1, wherein the locking piece further comprises a body and a shielding part connected to the body, wherein a first end of the body comprises a rotating column in a penetrating manner, and the rotating column is configured to be rotatably connected with an open end, wherein a second end of the body comprises a clamping part.

3. The electronic atomization device of claim 2, wherein when the body is forced to rotate around the rotating column, the clamping part and the shielding part are driven to rotate until the clamping part is clamped on the shell, and the shielding part protrudes in the mounting direction of the atomization core assembly.

4. The electronic atomization device of claim 2, wherein the shielding part comprises a connecting plate connected to the body and a baffle plate connected to the connecting plate, wherein the connecting plate extends along an axial direction of the mounting hole, and the baffle plate extends along a radial direction of the mounting hole and partially protrudes the mounting hole.

5. The electronic atomization device of claim 4, wherein the connecting plate comprises an arc plate structure arranged parallel to an outer wall of the mounting hole, wherein when the body rotates until the clamping part is clamped on the shell, the connecting plate attaches to the outer wall of the mounting hole.

6. The electronic atomization device of claim 2, wherein the body comprises an arc structure surrounding the mounting hole, and the open end comprises an adaptive arc avoidance groove, wherein when the clamping part is clamped on the shell, the body is completely accommodated in the arc avoidance groove.

7. The electronic atomization device of claim 2, wherein the clamping part is a buckle slot arranged on the body, the shell comprises a buckle adapted to the buckle slot, and the buckle slot is detachably engaged with the buckle.

8. The electronic atomization device of claim 2, wherein the rotating column comprises a column body and a column cap, the body comprises a first connecting hole, and the shell comprises a second connecting hole, wherein one end of the column body passes through the first connecting hole with a clearance and is inserted into the second connecting hole, the other end is connected to the column cap, and the column cap is attached to an end face of the first connecting hole.

9. The electronic atomization device of claim 8, wherein the part of the column body accommodated in the second connecting hole comprises at least one circular barb along the circumferential direction, wherein the circular barb is embedded in the hole wall of the second connecting hole, and the outer diameter of the circular barb gradually expands along the direction close to the first connecting hole.

10. The electronic atomization device of claim 1, wherein a first side of the locking piece is attached to the open end of the mounting hole, and a second side of the locking piece is exposed.

11. The electronic atomization device of claim 1, further comprising a buckle groove that is configured for a user to apply force.

12. An aerosol generator comprising:

a power supply unit; and an electronic atomization device, the electronic atomization device comprising:

a shell comprising a mounting hole;

an atomization core assembly comprising a first end and a second end, wherein the atomization core assembly is detachably mounted in the mounting hole, wherein the first end of the atomization core assembly is accommodated in the shell to form a juice storage cavity, and the second end of the atomization core assembly is accommodated outside of the shell; and a locking piece comprising a first end and a second end, wherein:

the first end of the locking piece is rotationally connected with an open end of the mounting hole, the second end of the locking piece is detachably connected with the shell, the first end of the locking piece is configured to rotate to the second end of the locking piece and to connect to the shell, the locking piece partially protrudes in a mounting direction of the atomization core assembly, and is configured to block the atomization core assembly from moving in the mounting direction, when the second end of the locking piece is disconnected from the shell, and the locking piece is configured to rotate around the first end in the direction away from the shell, and the locking piece is configured to unlock the atomization core assembly;

wherein the power supply unit is electrically connected to the electronic atomization device, wherein a first side of the atomization core assembly accommodated outside the shell comprises a groove along a circumferential direction, and wherein, when the locking piece rotates to the second end of the atomization core assembly and connects to the shell, a portion of the locking piece that partially protrudes along the mounting direction extends into the groove and is located between the opposite inner walls of the groove.

13. The aerosol generator of claim 12, wherein the locking piece further comprises a body and a shielding part connected to the body, wherein a first end of the body comprises a rotating column in a penetrating manner, and the rotating column is configured to be rotatably connected with an open end, wherein a second end of the body comprises a clamping part.

14. The aerosol generator of claim 13, wherein when the body is forced to rotate around the rotating column, the clamping part and the shielding part are driven to rotate until the clamping part is clamped on the shell, and the shielding part protrudes in the mounting direction of the atomization core assembly.

15. The aerosol generator of claim 13, wherein the shielding part comprises a connecting plate connected to the body and a baffle plate connected to the connecting plate, wherein the connecting plate extends along an axial direction of the mounting hole, and the baffle plate extends along a radial direction of the mounting hole and partially protrudes the mounting hole.

16. The aerosol generator of claim 15, wherein the connecting plate comprises an arc plate structure arranged parallel to an outer wall of the mounting hole, wherein when the body rotates until the clamping part is clamped on the shell, the connecting plate attaches to the outer wall of the mounting hole.

17. The aerosol generator of claim 12, wherein the body comprises an arc structure surrounding the mounting hole, and the open end comprises an adaptive arc avoidance groove, wherein when the clamping part is clamped on the shell, the body is completely accommodated in the arc avoidance groove.

18. The aerosol generator of claim 12, wherein the clamping part is a buckle slot arranged on the body, the shell comprises a buckle adapted to the buckle slot, and the buckle slot is detachably engaged with the buckle.

19. The aerosol generator of claim 12, wherein the rotating column comprises a column body and a column cap, the body comprises a first connecting hole, and the shell comprises a second connecting hole, wherein one end of the column body passes through the first connecting hole with a clearance and is inserted into the second connecting hole, the other end is connected to the column cap, and the column cap is attached to an end face of the first connecting hole.

20. An electronic atomization device comprising:

a shell comprising a mounting hole;

an atomization core assembly comprising a first end and a second end, wherein the atomization core assembly is detachably mounted in the mounting hole, wherein the first end of the atomization core assembly is accommodated in the shell to form a juice storage cavity, and the second end of the atomization core assembly is accommodated outside of the shell; and a locking piece comprising a first end and a second end, wherein:

the first end of the locking piece is rotationally connected with an open end of the mounting hole, the second end of the locking piece is detachably connected with the shell, the first end of the locking piece is configured to rotate to the second end of the locking piece and to connect to the shell, a portion of the locking piece partially protrudes in a mounting direction of the atomization core assembly, and is configured to block the atomization core assembly from moving in the mounting direction, when the second end of the locking piece is disconnected from the shell, and the locking piece is configured to rotate around the first end in the direction away from the shell, and the locking piece is configured to unlock the atomization core assembly, wherein the locking piece further comprises a body and a shielding part connected to the body, and wherein a first end of the body comprises a rotating column in a penetrating manner, and the rotating column is configured to be rotatably connected with an open end, wherein a second end of the body comprises a clamping part.

* * * * *